US008791627B2

(12) United States Patent
Ozeki et al.

(10) Patent No.: US 8,791,627 B2
(45) Date of Patent: Jul. 29, 2014

(54) SPARK PLUG CONFIGURED TO REDUCE THE OCCURANCE OF FLASHOVER

(71) Applicant: NGK Spark Plug Co., Ltd., Nagoya (JP)

(72) Inventors: Keiji Ozeki, Aichi-ken (JP); Naoyuki Mukoyama, Aichi-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/034,610

(22) Filed: Sep. 24, 2013

(65) Prior Publication Data

US 2014/0084776 A1 Mar. 27, 2014

(30) Foreign Application Priority Data

Sep. 27, 2012 (JP) ..... 2012-213513

(51) Int. Cl.
*H01T 13/36* (2006.01)
*H01T 13/34* (2006.01)

(52) U.S. Cl.
USPC ..... 313/144; 313/143; 313/145; 123/169 R

(58) Field of Classification Search
CPC ..... H01T 13/36; H01T 13/20; H01T 13/34
USPC ..... 313/118–144, 145; 123/169 R, 169 EL
See application file for complete search history.

(56) References Cited

U.S. PATENT DOCUMENTS

| | | | | |
|---|---|---|---|---|
| 6,091,185 | A * | 7/2000 | Matsubara et al. | 313/138 |
| 6,229,253 | B1 * | 5/2001 | Iwata et al. | 313/141 |
| 7,187,110 | B2 * | 3/2007 | Suzuki | 313/141 |
| 7,382,085 | B2 * | 6/2008 | Suzuki | 313/141 |
| 7,723,906 | B2 * | 5/2010 | Kadowaki et al. | 313/143 |
| 7,795,791 | B2 * | 9/2010 | Joseph et al. | 313/141 |

FOREIGN PATENT DOCUMENTS

| | | | |
|---|---|---|---|
| JP | H06-196247 | 7/1994 | H01T 13/20 |

* cited by examiner

*Primary Examiner* — Tracie Y Green
(74) *Attorney, Agent, or Firm* — Kusner & Jaffe

(57) ABSTRACT

A spark plug includes an insulator, and a metal shell disposed at an outer periphery of the insulator and including a shoulder. The insulator includes a trunk portion, and a leg formed at the tip end side of the trunk portion. The shoulder of the metal shell includes a first shoulder, and a second shoulder formed at the tip end side of the first shoulder. A distance Da between the tip end of the second shoulder and the leg and a distance Db between the tip end of the trunk portion and the second shoulder satisfy a relationship of Da/Db≥1.1. A distance T between the rear end of the first shoulder and the tip end of the second shoulder and a distance L between the rear end of the first shoulder and a tip end face of the metal shell satisfy a relationship of T/L≤0.5.

5 Claims, 3 Drawing Sheets

SPARK PLUG CONFIGURED TO REDUCE THE OCCURANCE OF FLASHOVER

FIELD OF THE INVENTION

This disclosure relates to a spark plug.

BACKGROUND OF THE INVENTION

A spark plug is used to ignite an internal combustion engine such as a gasoline engine. The spark plug generally includes a center electrode, an insulator disposed at an outer side of the center electrode, a metal shell disposed at an outer side of the insulator, and a ground electrode. The ground electrode is installed on the metal shell and forms a spark discharge gap between the ground electrode itself and the center electrode.

A spark plug as described above is disclosed in, for example, Japanese Patent Application Laid-Open No. 6-196247. This spark plug includes a leg base portion at the insulator. The leg base portion faces a step portion formed on the metal shell with a clearance therebetween. The leg base portion is formed approximately parallel to the axis line of the spark plug. This leg base portion inhibits a combustion gas from entering between the insulator and the metal shell so as to reduce variation in heat resistance.

SUMMARY OF THE INVENTION

In accordance with the present invention, there is provided a spark plug comprised of: an insulator having an axial hole penetrating in an axial direction and a center electrode disposed at a tip end side of the axial hole; and a tubular metal shell disposed at an outer periphery of the insulator for holding the insulator. The metal shell includes a shoulder formed to project from an inner peripheral surface of the metal shell inward in a radial direction. The insulator includes: a lock portion locked at the shoulder; a trunk portion formed at a tip end side of the lock portion; and a leg formed at the tip end side of the trunk portion. The leg includes a reduced diameter portion with an outer diameter reduced toward the tip end side, the leg having a smaller outer diameter than an outer diameter of the trunk portion. The shoulder of the metal shell includes: a first shoulder that has an inner diameter reduced from a rear end side toward the tip end side; and a second shoulder formed at the tip end side of the first shoulder. The second shoulder extends to face the trunk portion. The tip end of the second shoulder is positioned at the tip end side with respect to the tip end of the trunk portion in the axial direction. A distance Da between the tip end of the second shoulder and the leg along the radial direction and a distance Db between the tip end of the trunk portion and the second shoulder along the radial direction satisfy a relationship in Expression 1 (set forth below), and a distance T and a distance L satisfy a relationship in Expression 2 (set forth below). The distance T is a distance between the rear end of the first shoulder and the tip end of the second shoulder along the axial direction, the distance L being a distance between the rear end of the first shoulder and a tip end face of the metal shell along the axial direction.

$$Da/Db \geq 1.1 \quad \text{(Expression 1)}$$

$$T/L \leq 0.5 \quad \text{(Expression 2)}$$

DETAILED DESCRIPTION OF PREFERRED EMBODIMENTS

Figure 1:
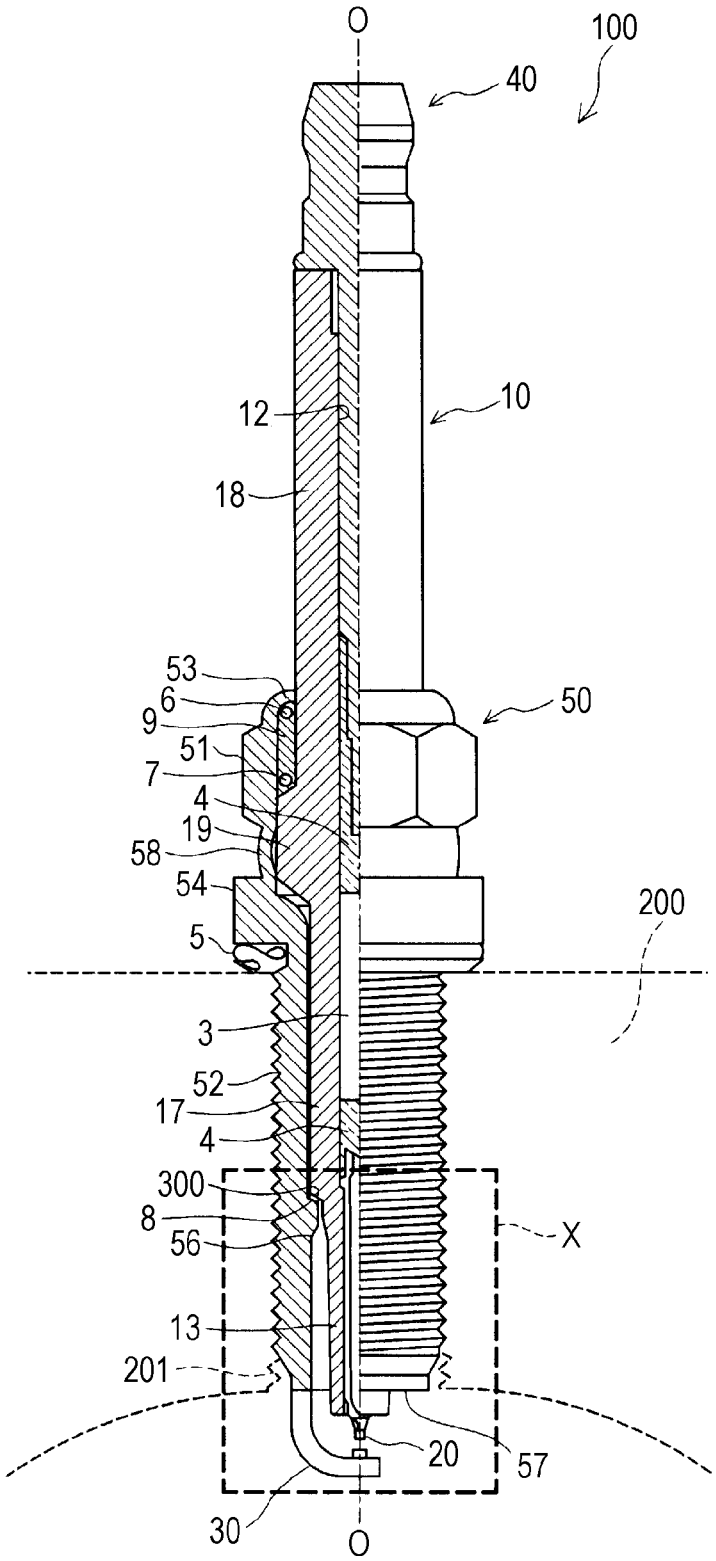
FIG. 1 is a partial sectional view of a spark plug according to a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In a conventional spark plug, the end portion at the combustion chamber side of the leg base portion of the insulator is positioned at the combustion chamber side with respect to the end portion at the combustion chamber side of the metal shell. Accordingly, depending on a state of accumulated carbon on the insulator, creeping discharge occurs along the carbon accumulated on an external surface of the insulator. This may cause flying sparks (a lateral spark and/or a flashover) to the metal shell.

In recent years, under a condition at high voltage required for the spark plug, possibility to cause the flashover becomes higher. Occurrence of the flashover decreases frequency of flying sparks with a regular spark gap. This reduces ignitability of air-fuel mixture. Accordingly, regarding the spark plug, a technique that can reduce occurrence of the flashover also under the condition at high voltage is desired. Additionally, the spark plug is desired to, for example, ensure low cost, save resources, facilitate manufacturing, and improve durability.

This disclosure can be realized as the following embodiment.

(1) According to an embodiment of the disclosure, a spark plug is provided. The spark plug includes: an insulator having an axial hole penetrating in an axial direction and a center electrode disposed at a tip end side of the axial hole. A tubular metal shell is disposed at an outer periphery of the insulator for holding the insulator, the metal shell including a shoulder formed to project from an inner peripheral surface of the metal shell inward in a radial direction. The insulator includes: a lock portion locked at the shoulder; a trunk portion formed at a tip end side of the lock portion; and a leg formed at the tip end side of the trunk portion. The leg includes a reduced diameter portion with an outer diameter reduced toward the tip end side, the leg having a smaller outer diameter than an outer diameter of the trunk portion. The shoulder of the metal shell includes: a first shoulder that has an inner diameter reduced from a rear end side toward the tip end side; and a second shoulder formed at the tip end side of the first shoulder, the second shoulder extending to face the trunk portion. The tip end of the second shoulder is positioned at the tip end side with respect to the tip end of the trunk portion in the axial direction. A distance Da between the tip end of the second shoulder and the leg along the radial direction and a distance Db between the tip end of the trunk portion and the second shoulder along the radial direction satisfy a relationship in Expression 1, and a distance T and a distance L satisfy a relationship in Expression 2. The distance T is a distance between the rear end of the first shoulder and the tip end of the second shoulder along the axial direction, and the distance L is a distance between the rear end of the first shoulder and a tip end face of the metal shell along the axial direction.

$$Da/Db \geq 1.1 \quad \text{(Expression 1)}$$

$$T/L \leq 0.5 \quad \text{(Expression 2)}$$

With the spark plug in this embodiment, satisfying the relationship in Expression 1 ensures a sufficient space between the tip end of the second shoulder of the metal shell and the insulator. This suppresses the occurrence of the electric field concentration adjacent to the tip end of the second shoulder of the metal shell. Additionally, satisfying Expression 2 ensures a sufficiently lengthened distance between the tip end face and the rear end of the shoulder in the metal shell. This ensures sufficiently lengthened discharge distance on the surface over the insulator that is a path of the flashover. Accordingly, anti-flashover performance is improved.

(2) In the spark plug in the embodiment, a distance Dc may be equal to or more than 0.2 mm, the distance Dc being a distance between the tip end of the second shoulder and the tip end of the trunk portion along the axial direction.

The spark plug in this embodiment ensures the sufficiently lengthened distance between the tip end of the second shoulder of the metal shell and the tip end of the trunk portion of the insulator along the axis line direction. This further suppresses the occurrence of the electric field concentration adjacent to the tip end of the second shoulder of the metal shell.

(3) In the spark plug in the embodiment, a distance Db' between a point on the leg and the second shoulder along the radial direction may satisfy a relationship in Expression 3, the point being shifted to the tip end side by 0.1 mm along the axis line from the tip end of the trunk portion.

$$Db' \leq 1.8 \times Db \quad \text{(Expression 3)}$$

The spark plug in this embodiment inhibits combustion gas from entering into the space formed between the shoulder of the metal shell and the insulator. This reduces variation in heat rating while improving anti-flashover performance.

(4) In the spark plug in the embodiment, the second shoulder may be formed to have an inner diameter that expands from a rear end side toward a tip end side.

The spark plug in this embodiment ensures a wider distance between the tip end of the second shoulder of the metal shell and the insulator compared with the case where the second shoulder is formed along the axis line. Accordingly, this further suppresses the occurrence of the electric field concentration adjacent to the tip end of the second shoulder of the metal shell. As a result, the occurrence of the flashover is suppressed.

(5) In the spark plug in the embodiment, the trunk portion may be formed to extend along the axis line with a constant outer diameter.

The spark plug in this embodiment ensures a narrower distance between the second shoulder of the metal shell and the trunk portion of the insulator compared with the case where the trunk portion is formed to have a reduced diameter toward the tip end. Accordingly, this inhibits combustion gas from entering between the metal shell and the insulator. As a result, this reduces variation in heat rating while improving anti-flashover performance.

This disclosure can be achieved by various embodiments. This disclosure can be achieved by, for example, an embodiment of a method for manufacturing a spark plug.

First Embodiment

A1. Schematic Configuration of Spark Plug

FIG. 1 is a partial sectional view of a spark plug 100 according to a first embodiment. The spark plug 100 has an elongated shape along an axis line O as illustrated in FIG. 1. In FIG. 1, a right side with respect to the axis line O-O illustrated by one-dot chain line shows an external front of the spark plug 100. On the other hand, a left side with respect to the axis line O-O shows a cross section passing through the central axis of the spark plug 100. In the following description, a lower side of FIG. 1 parallel to the axis line O is referred to as a tip end side. On the other hand, an upper side of FIG. 1 parallel to the axis line O is referred to as a rear end side.

The spark plug 100 includes an insulator 10, a center electrode 20, a ground electrode 30, a metal terminal 40, and a metal shell 50. The center electrode 20 is a rod-shaped member that projects from one end of the insulator 10. This center electrode 20 passes through the inside of the insulator 10 and electrically connects to the metal terminal 40 disposed at the other end of the insulator 10. An outer periphery of the center electrode 20 is held by the insulator 10. An outer periphery of the insulator 10 is held by the metal shell 50 in a position apart from the metal terminal 40. The ground electrode 30 electrically connects to the metal shell 50. The ground electrode 30 forms a spark gap between the ground electrode 30 and a tip end of the center electrode 20. The spark gap is a clearance to generate spark.

The spark plug 100 is installed on a mounting screw hole 201 via the metal shell 50. The mounting screw hole 201 is disposed at an engine head 200 of an internal combustion engine. When a high voltage of 20 to 30 thousand volts is applied to the metal terminal 40, a spark occurs at the spark gap formed between the center electrode 20 and the ground electrode 30.

The insulator 10 is an insulator formed by sintering a ceramic material including alumina. The insulator 10 is a tubular member. At the center of the insulator 10, an axial hole 12, that houses the center electrode 20 and the metal terminal 40, is formed. At the center of the insulator 10 in the axial direction, a center trunk portion 19 with a large outer diameter is formed. At the metal terminal 40 side of the insulator 10 with respect to the center trunk portion 19, a rear-end-side trunk portion 18, that insulates between the metal terminal 40 and the metal shell 50, is formed. At the center electrode 20 side of the insulator 10 with respect to the center trunk portion 19, a tip-end-side trunk portion 17, that has a smaller outer diameter than that of the rear-end-side trunk portion 18, is formed. At a further tip side of the tip-end-side trunk portion 17, a leg portion 13, that has an outer diameter equal to or less than the outer diameter of the tip-end-side trunk portion 17, is formed.

The metal shell 50 is a cylindrically-shaped metal shell that surrounds and holds a portion from a part of the rear-end-side trunk portion 18 of the insulator 10 to the leg portion 13. In this embodiment, the metal shell 50 is formed of low-carbon steel. A plating process such as nickel plating and zinc plating is performed on the entire metal shell 50. The metal shell 50 includes a tool engagement portion 51, a mounting screw portion 52, and a seal portion 54. The tool engagement portion 51 of the metal shell 50 fits a tool (not shown) for installing the spark plug 100 on the engine head 200. The mounting screw portion 52 of the metal shell 50 has a thread to be threadably mounted on the mounting screw hole 201 of the engine head 200. The seal portion 54 of the metal shell 50 is formed in a flange shape at the base of the mounting screw portion 52. Between the seal portion 54 and the engine head 200, an annular gasket 5 formed by folding a sheet is fitted by insertion. A tip end face 57 of the metal shell 50 has a hollow disk shape. An end portion of the leg portion 13 of the insulator 10 and the center electrode 20 project from the tip end face 57.

At the rear end side of the metal shell 50 with respect to the tool engagement portion 51, a thin walled caulking portion 53 is disposed. Between the seal portion 54 and the tool engagement portion 51, a compression deformation portion 58 that is thin walled similarly to the caulking portion 53 is disposed. Annular ring members 6 and 7 are interposed between an inner peripheral surface of the metal shell 50 and an outer peripheral surface of the rear-end-side trunk portion 18 of the insulator 10 from the tool engagement portion 51 to the caulking portion 53. Powders of talc 9 are filled up between both the ring members 6 and 7. During manufacturing of the spark plug 100, the caulking portion 53 is pressed to the tip end side to be folded inward. This causes compression deformation of the compression deformation portion 58. This compression deformation of the compression deformation portion 58 is pressed by the insulator 10 toward the tip end side inside of the metal shell 50 via the ring members 6 and 7 and the talc 9. This pressing compresses the talc 9 in the axis line O direction. As a result, air tightness inside of the metal shell 50 is enhanced.

At the inner peripheral side of the metal shell 50, an in-metal shell shoulder 56 is formed in a position of the mounting screw portion 52. The in-metal shell shoulder 56 presses a lock portion 300 positioned at the base end of the leg portion 13 of the insulator 10 via an annular sheet packing 8. This sheet packing 8 is a member that maintains air tightness between the metal shell 50 and the insulator 10. The sheet packing 8 prevents or reduces outflow of combustion gas.

The center electrode 20 is a rod-shaped member that includes an electrode base material and a core material (both are not shown). The core material that is excellent in thermal conductivity compared with the electrode base material is buried inside of the electrode base material. In this embodiment, the electrode base material contains a nickel alloy where a nickel is the main constituent. The core material contains a copper or an alloy where a copper is the main constituent. A rear end portion of the center electrode 20 electrically connects to the metal terminal 40 via the ceramic resistor 3 and the seal body 4.

The ground electrode 30 contains metal (such as a nickel alloy) with high corrosion resistance. The ground electrode 30 has a base end that is welded to the tip end face 57 of the metal shell 50. The tip end side of the ground electrode 30 is bent in a direction intersecting the axis line O. A tip end portion of the ground electrode 30 faces the tip end face of the center electrode 20 on the axis line O. Here, the ground electrode 30 may be a rod-shaped member that includes an electrode base material and a core material (both are not shown) similarly to the center electrode 20. In this case, the core material that is excellent in thermal conductivity compared with the electrode base material is buried inside of the electrode base material.

A2. Detailed Configurations of Insulator and Metal Shell

Figure 2A:
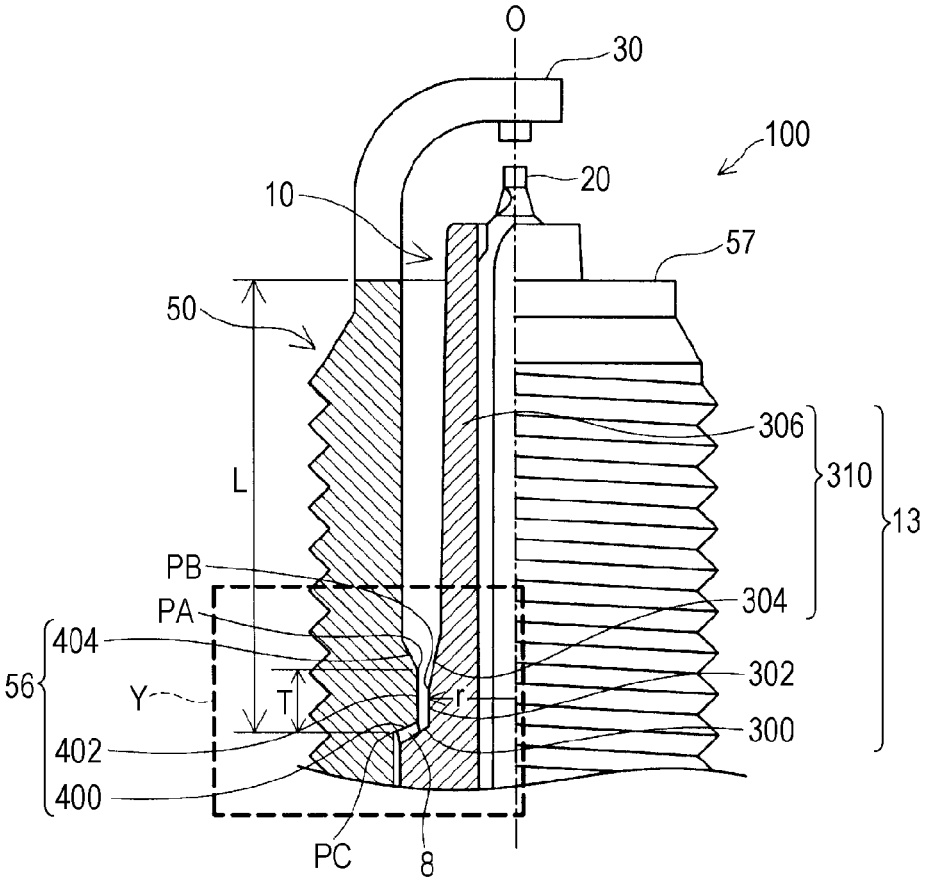
FIGS. 2A and 2B are partial expansion (enlarged) figures each illustrating a tip end portion of the spark plug according to the first embodiment.
Figure 2B:
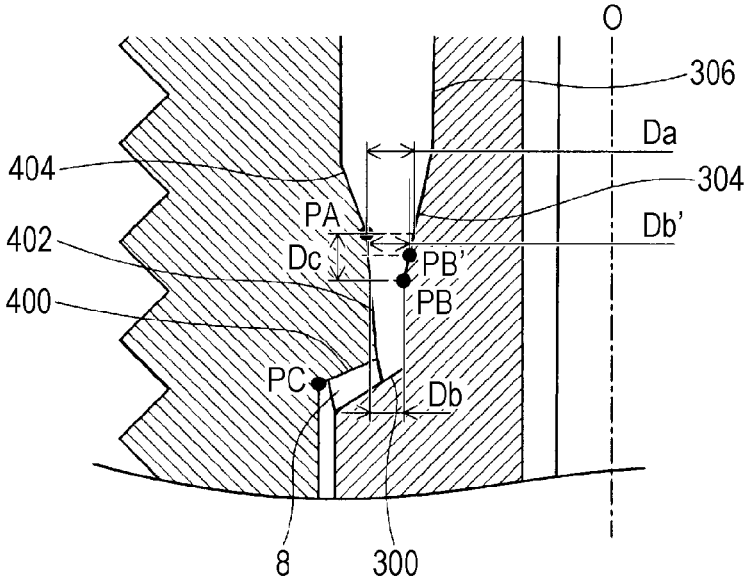

FIGS. 2A and 2B are partial, expansion (enlarged) figures each illustrating the tip end portion of the spark plug 100 according to a first embodiment. FIG. 2A illustrates an expansion of a frame X in FIG. 1. FIG. 2B illustrates an expansion of a frame Y in FIG. 2A. As illustrated in FIG. 2A, the leg portion 13 of the insulator 10 includes the lock portion 300, a first trunk portion 302, a reduced diameter portion 304, and a second trunk portion 306. The lock portion 300 is engaged with the in-metal shell shoulder 56. The first trunk portion 302 is formed at the tip end side of the lock portion 300. The reduced diameter portion 304 is formed at the tip end side of the first trunk portion 302. An outer diameter of the reduced diameter portion 304 is gradually decreased toward the tip end side (the diameter is reduced). The second trunk portion 306 is formed at the tip end side of the reduced diameter portion 304. An outer diameter of the second trunk portion 306 is smaller than an outer diameter of the first trunk portion 302. The reduced diameter portion 304 and the second trunk portion 306 are collectively referred to also as a leg 310. The first trunk portion 302 is formed to extend with a constant outer diameter (a radius r in the first embodiment) along the axis line O. The first trunk portion 302 may be a member equivalent to a "trunk portion" in the claims.

The in-metal shell shoulder 56 of the metal shell 50 includes a first shoulder 400, a second shoulder 402, and a third shoulder 404. An inner diameter of the first shoulder 400 is reduced from the rear end side toward the tip end side. The second shoulder 402 is formed at the tip end side of the first shoulder 400, and extends to face the first trunk portion 302 of the insulator 10. The third shoulder 404 is formed at the tip end side of the second shoulder 402. The inner diameter of the third shoulder 404 gradually becomes larger from the rear end side toward the tip end side (the diameter is expanded). The second shoulder 402 is formed in a taper shape to have an inner diameter that is expanded from the rear end side toward the tip end side.

As illustrated in FIG. 2A and FIG. 2B, the leg portion 13 of the insulator 10 and the in-metal shell shoulder 56 of the metal shell 50 are disposed to be separated from each other by a predetermined distance.

As illustrated in FIG. 2A and FIG. 2B, a tip end PA is an end portion at the tip end side of the second shoulder 402. A tip end PB is an end portion at the tip end side of the first trunk portion 302 of the insulator 10. A rear end PC is an end portion at the rear end side of the first shoulder 400. A distance Da is a distance between the tip end PA of the second shoulder 402 and the insulator 10 along the radial direction. A distance Db is a distance between the tip end PB of the first trunk portion 302 and the metal shell 50 (the second shoulder 402) along the radial direction. A distance T is a distance between the rear end PC of the first shoulder 400 and the tip end PA of the second shoulder 402 along the axis line O direction. A distance L is a distance between the rear end PC of the first shoulder 400 and the tip end face 57 of the metal shell 50 along the axis line O direction.

The spark plug 100 in the first embodiment is formed such that the distance Da and the distance Db satisfy a relationship in Expression 1, and the distance T and the distance L satisfy a relationship in Expression 2.

$$Da/Db \geq 1.1 \quad \text{(Expression 1)}$$

$$T/L \leq 0.5 \quad \text{(Expression 2)}$$

The reason that the spark plug 100 is preferably formed to satisfy Expressions 1 and 2 described above will be described. The shoulder 56 is formed to project at the inner periphery of the metal shell 50. Especially, the tip end PA, which is a connection point between the second shoulder 402 and the third shoulder 404, forms a corner portion. Accordingly, electric field concentration is likely to occur at tip end PA. Therefore, in the axis line O direction, the tip end of the second shoulder 402 is preferred to be positioned at the tip end side of the spark plug 100 with respect to the tip end of the first trunk portion 302, and the insulator 10 and the metal shell 50 are preferred to be formed to satisfy Expression 1. This ensures a sufficient space (clearance) between the tip end PA of the second shoulder 402 and the insulator 10. As a result, this suppresses the occurrence of the electric field concentration adjacent to the tip end PA of the second shoulder 402 of the metal shell 50. Additionally, satisfying Expression 2 ensures a sufficiently lengthened distance between the tip end face 57 and the rear end (the rear end PC of the first shoulder 400) of the shoulder 56 in the metal shell 50. This ensures sufficiently lengthened discharge distance on a surface over the insulator 10 that is a path of the flashover. Accordingly, occurrence of the flashover is suppressed.

A distance between the tip end PA of the second shoulder 402 and the tip end PB of the first trunk portion 302 along the axis line O direction is assumed to be a distance Dc. The spark plug 100 is formed to have the distance Dc equal to or more than 0.2 mm.

A point adjacent to the tip end PB of the first trunk portion 302 at the tip end side, specifically, a point shifted to the tip end side by 0.1 mm from the tip end PB along the axis line O on the leg portion 13 is assumed to be a point PB'. A distance between the point PB' and the second shoulder 402 along the radial direction is assumed to be a distance Db'. The spark plug 100 is formed such that the distance Db' satisfies a relationship in Expression 3.

$$Db' \leq 1.8 \times Db \quad \text{(Expression 3)}$$

The value of "0.1 mm" means that the point PB' is a point adjacent to the tip end PB. Table 1 shows sizes of respective portions in various types of spark plugs (Samples 1 to 3). These samples are different in trunk diameter (outer diameter) of the first trunk portion 302 of the insulator 10 and in shelf diameter (inner diameter) of the second shoulder 402 of the metal shell 50. In Table 1, "TRUNK DIAMETER" means the trunk diameter (outer diameter) of the first trunk portion 302 of the insulator 10. "SHELF DIAMETER" means the shelf diameter (inner diameter) of the second shoulder 402 of the metal shell 50. The clearance means a distance in the radial direction between the first trunk portion 302 and the second shoulder 402 at the tip end PB. Here, Db' is a value in the case where the point PB' is assumed to be in a position shifted to the tip end side by 0.1 mm from the tip end PB along the axis line O on the leg portion 13.

As illustrated in Table 1, even in the case where a diameter size of the metal shell 50 or the insulator 10 of the spark plug is varied, a clearance between the trunk diameter (outer diameter) of the first trunk portion 302 of the insulator 10 and the shelf diameter (inner diameter) of the second shoulder 402 of the metal shell 50 are not significantly different from each other. Additionally, the difference between the distance Db' and the ratio Db'/Db is considered to be approximately equal. Therefore, in this embodiment, the point shifted to the tip end side by 0.1 mm from the tip end PB along the axis line O on the leg portion 13 is used as the point adjacent to the tip end PB.

TABLE 1

| Screw Diameter | Sample 1 | Sample 2 | Sample 3 |
|---|---|---|---|
| Trunk Diameter (Outer Diameter) | 4.7 | 5.7 | 7.4 |
| Shelf Diameter (Inner Diameter) | 5.1 | 6.2 | 7.9 |
| Clearance | 0.2 | 0.25 | 0.25 |
| Db' | 0.262 | 0.338 | 0.317 |
| Db'/Db | 1.31 | 1.35 | 1.27 |

With the spark plug 100 in the first embodiment described above, satisfying the relationship in Expression 1 ensures a sufficient space between the tip end PA of the second shoulder 402 of the metal shell 50 and the insulator 10. This suppresses the occurrence of the electric field concentration adjacent to the tip end of the second shoulder 402 of the metal shell 50. Additionally, satisfying Expression 2 ensures a sufficiently lengthened distance L between the tip end face 57 and the rear end PC of the shoulder 56 in the metal shell 50. This ensures sufficiently lengthened discharge distance on the surface over the insulator 10 that is a path of the flashover. Accordingly, anti-flashover performance is improved.

With the spark plug 100 of the first embodiment, the distance Dc is equal to or more than 0.2 mm. This ensures the sufficiently lengthened distance between the tip end PA of the second shoulder 402 of the metal shell 50 and the tip end PB of the first trunk portion 302 of the insulator 10 along the axis line O direction. This further suppresses the occurrence of the electric field concentration adjacent to the tip end PA of the second shoulder 402 of the metal shell 50.

With the spark plug 100 of the first embodiment, the relationship in Expression 3 is satisfied. This prevents combustion gas from entering into the space formed between the shoulder 56 of the metal shell 50 and the insulator 10. This reduces variation in heat rating while improving anti-flashover performance.

With the spark plug 100 of the first embodiment, the second shoulder 402 is formed to expand the inner diameter. This ensures a wider distance between the tip end PA of the second shoulder 402 of the metal shell 50 and the insulator 10 compared with the case where the second shoulder 402 is formed along the axis line O. Accordingly, this further suppresses the occurrence of the electric field concentration adjacent to the tip end PA of the second shoulder 402 of the metal shell 50. As a result, the occurrence of the flashover is suppressed.

Additionally, with the spark plug 100 of the first embodiment, the first trunk portion 302 is formed to have the constant outer diameter along the axis line O. This ensures a narrower distance between the second shoulder 402 of the metal shell 50 and the first trunk portion 302 of the insulator 10 compared with the case where the first trunk portion 302 is formed to have a reduced diameter toward the tip end of the spark plug 100. Accordingly, this prevents combustion gas from entering between the metal shell 50 and the insulator 10. As a result, the anti-flashover performance is improved.

B. Evaluation Results

A description will be given of results of test and evaluation regarding the anti-flashover performance and the heat resistance (heat rating) of the spark plugs that satisfy various conditions described in the first embodiment.

(Test 1) Evaluation on a relationship between: the conditions in Expression 1 and Expression 2, and incidence of flashover.

In Test 1, the spark plug was installed on a see-through chamber. This spark plug was discharged, and the discharge and a discharge wave form were synchronized with each other so as to observe the discharge (the discharge wave form). Thus, the incidence (unit: %) of the flashover was evaluated. In Test 1, under a pressure of 0.8 Mp, the spark plug was repeatedly sparked 200 times in a state where a spark discharge gap between the center electrode 20 and the ground electrode 30 was increased by 0.2 mm from the initial value (0.8 mm). Dimensions of the samples (spark plugs) used in the test are shown in Table 2. Evaluation results are shown in Table 3.

Judgment results A and B shown in Table 3 are as follows.

A: The incidence of flashover is less than 1%, and the incidence of flashover is low.

B: The incidence of flashover is equal to or more than 1%, and the incidence of flashover is ordinary.

The incidence of flashover was calculated by applying Expression 4 below.

Incidence of Flashover(unit:%)=the number of incidence of flashover/the number of sparks×100 (Expression 4).

TABLE 2

| Da | Db | Da/Db |
|---|---|---|
| 0.23 | 0.25 | 0.9 |
| 0.25 | 0.25 | 1.0 |
| 0.28 | 0.25 | 1.1 |
| 0.40 | 0.25 | 1.6 |
| 0.50 | 0.25 | 2.0 |

TABLE 3

| Da/Db | 0.9 | 1.0 | 1.1 | 1.6 | 2.0 |
|---|---|---|---|---|---|
| T/L = 0.3 | B | B | A | A | A |
| T/L = 0.4 | B | B | A | A | A |
| T/L = 0.5 | B | B | A | A | A |
| T/L = 0.6 | B | B | B | B | B |

As shown in Table 3, in the spark plug that satisfies Da/Db≥1.1 (Expression 1) and T/L≤0.5 (Expression 2), the incidence of flashover was less than 1% irrespective of the values of the distances Da and Db. That is, manufacturing the spark plug to satisfy Expressions 1 and 2 improves the anti-flashover performance.

(Test 2) Evaluation on a relationship between the distance Dc and the incidence of flashover in spark plugs that satisfy Expression 1.

In Test 2, the spark plug was installed on the see-through chamber similarly to Test 1. This spark plug was discharged, and the discharge and a discharge wave form were synchronized with each other so as to observe the discharge. Thus, the incidence (unit: %) of the flashover was evaluated. In Test 2, similarly to Test 1, under a pressure of 1.0 Mp, the spark plug was repeatedly sparked 200 times in a state where a spark discharge gap between the center electrode 20 and the ground electrode 30 was increased by 0.2 mm from the initial value (0.8 mm). Evaluation results are shown in Table 4. Judgment results A and B shown in Table 4 are as follows.

A: The incidence of flashover is less than 1%, and the incidence of flashover is low.

B: The incidence of flashover is equal to or more than 1%, and the incidence of flashover is ordinary.

The incidence of flashover was calculated by applying Expression 4 in Test 1.

TABLE 4

| | Dc | | | |
|---|---|---|---|---|
| Da/Db | 0.1 | 0.2 | 0.3 | 0.4 |
| 1.1 | B | A | A | A |
| 1.6 | B | A | A | A |
| 2.0 | B | A | A | A |

As shown in Table 4, in the spark plug that satisfies the condition where the distance Dc is equal to or more than 0.2 mm, the incidence of flashover was less than 1%. That is, this spark plug has a high anti-flashover performance.

(Test 3) Evaluation on a relationship between the condition in Expression 3 and a heat rating of the spark plug.

In Test 3, it was evaluated whether or not a heat rating of the spark plug was shifted from the heat rating of the reference spark plug while the ignition timing of the spark plug was varied. Generally, a heat transfer performance (a heat resistance) of the spark plug is expressed by the "heat rating". This heat rating is measured by a method specified by the U.S. Society of Automotive Engineers standard.

In Test 3, a pre-ignition occurrence advance angle for each ignition timing was measured while the engine was operated under the following test condition and the ignition timing of the spark plug of the sample was varied. Here, the "pre-ignition occurrence advance angle" means an ignition advance where pre-ignition (ignition at too fast timing) occurs.

Engine: 4-cycle DOHC engine having a displacement of 1.6 liters

Fuel: unleaded high-octane gasoline

Room temperature/humidity: 20° C./60%

Oil temperature: 80° C.

Test pattern: engine revolution of 5500 rpm, wide open throttle (for two minutes).

Evaluation results are shown in Table 5. Judgment results A and B shown in Table 5 are as follows.

A: Displacement of the ignition advance from that of the reference spark plug is less than 5° or does not occur. Therefore, displacement of the heat rating does not occur.

B: Displacement of the ignition advance from that of the reference spark plug is equal to or more than 5°. Therefore, displacement of the heat rating occurs.

TABLE 5

| Db'/Db | | | | | |
|---|---|---|---|---|---|
| 1 | 1.2 | 1.6 | 1.7 | 1.8 | 1.9 |
| A | A | A | A | A | B |

As shown in Table 5, displacement between the heat rating of the spark plug satisfying Expression 3 and the heat rating of the reference spark plug does not occur or is within an allowable range (less than 5° in the ignition advance). Accordingly, satisfying Expression 3 inhibits combustion gas from entering between the shoulder 56 of the metal shell 50 and the insulator 10 in the spark plug. Therefore, the displacement of the heat rating of the spark plug is considered to be reduced (in other words, variation in heat resistance is reduced).

Figure 3:
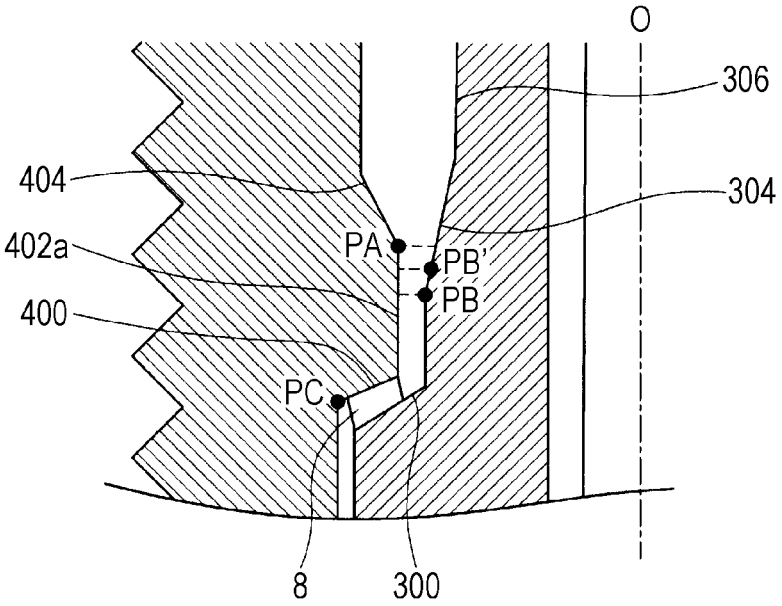
FIG. 3 is a partial expansion (enlarged) figure illustrating a portion adjacent to a shoulder of the spark plug according to a modification.

C. Modifications (1) In the first embodiment, the second shoulder 402 is formed to have the inner diameter that expands from the rear end side toward the tip end side in the spark plug 100. The inner diameter of the second shoulder 402 may be constant from the rear end side to the tip end side in the spark plug 100. FIG. 3 is a partial, expansion (enlarged) figure illustrating expansion (enlargement) of a portion adjacent to the shoulder 56 of the spark plug according to this modification (Modification 1). In the spark plug of Modification 1, a second shoulder 402*a* of the shoulder 56 of the metal shell 50 is formed to have a constant inner diameter along the axis line O. This ensures a narrower distance between the second shoulder 402*a* of the metal shell 50 and the first trunk portion 302 of the insulator 10. Accordingly, this inhibits combustion gas from entering between the metal shell 50 and the insulator 10. As a result, the displacement of the heat rating of the spark plug is reduced.

Figure 4:
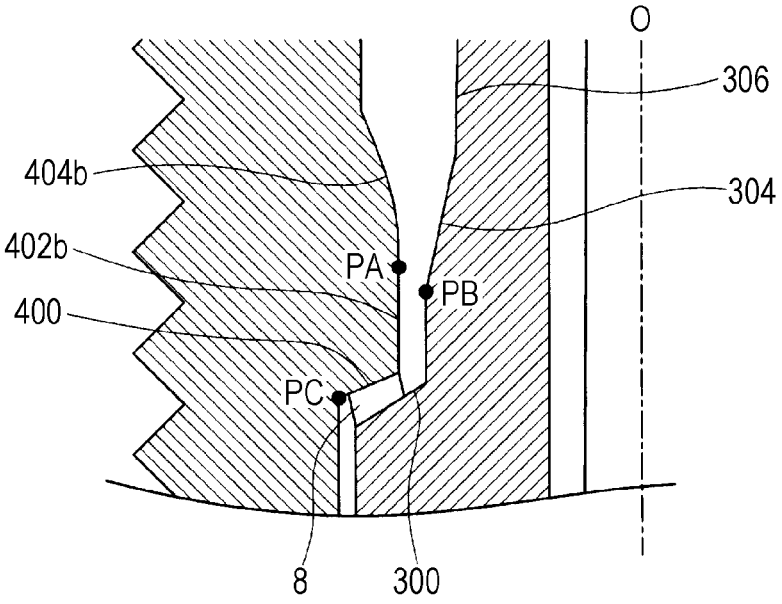
FIG. 4 is a partial expansion (enlarged) figure illustrating a portion adjacent to the shoulder of the spark plug according to a modification.

(2) FIG. 4 is a partial, expansion (enlarged) figure illustrating expansion (enlargement) of a portion adjacent to the shoulder 56 of the spark plug according to Modification 2. In the spark plug of Modification 2, a curved line connects between a second shoulder 402*b* and a third shoulder 404*b* in the shoulder 56 of the metal shell 50. This inhibits forming of a corner portion where the electric field concentration is likely to occur between the second shoulder 402*b* and the third shoulder 404*b*. Therefore, this suppresses the occurrence of the electric field concentration between the shoulder 56 and the insulator 10. As a result, the anti-flashover performance is improved.

(3) In the first embodiment, the distance Dc between the tip end PA of the second shoulder 402 and the tip end PB of the first trunk portion 302 along the axis line O direction is equal to or more than 0.2 mm. The distance Dc is not limited to this, and may be larger than 0.2 mm.

(4) In the first embodiment, the distance Db' between the point PB', which is shifted to the tip end side by 0.1 mm from the tip end PB of the first trunk portion 302 along the axis line O, and the second shoulder 402 along the radial direction satisfies the relationship in Expression 3. The distance Db' is not limited to this, and may be set to satisfy Db'>1.8×Db.

(5) In the first embodiment, the first trunk portion 302 is formed to extend along the axis line O with the constant outer diameter. The first trunk portion 302 is not limited to this, and may be formed, for example, to change (for example, reduce in diameter) its inner diameter from the rear end side toward the tip end side in the spark plug 100.

This disclosure is not limited to the above-described embodiments, working examples, and modifications. This disclosure may be practiced in various forms without departing from its spirit and scope. For example, to solve a part of or all of the above-described problems, or to achieve a part of or all of the above-described effects, the embodiments corresponding to the technical feature in each embodiment and the technical feature in the embodiments and the modifications disclosed in this description may be, as necessary, replaced or combined. If the technical feature is not described as essential in the description, it can be deleted as necessary.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

Having described the invention, the following is claimed:

1. A spark plug, comprising:

an insulator having an axial hole penetrating in an axial direction and a center electrode disposed at a tip end side of the axial hole; and a tubular metal shell disposed at an outer periphery of the insulator for holding the insulator, the metal shell including a shoulder formed to project from an inner peripheral surface of the metal shell inward in a radial direction, wherein the insulator includes:

a lock portion locked at the shoulder;

a trunk portion formed at a tip end side of the lock portion; and a leg formed at the tip end side of the trunk portion, the leg including a reduced diameter portion with an outer diameter reduced toward the tip end side, the leg having a smaller outer diameter than an outer diameter of the trunk portion, wherein the shoulder of the metal shell includes:

a first shoulder that has an inner diameter reduced from a rear end side toward the tip end side; and a second shoulder formed at the tip end side of the first shoulder, the second shoulder extending to face the trunk portion, wherein the tip end of the second shoulder is positioned at the tip end side with respect to the tip end of the trunk portion in the axial direction, a distance Da between the tip end of the second shoulder and the leg along the radial direction and a distance Db between the tip end of the trunk portion and the second shoulder along the radial direction satisfy a relationship in Expression 1, and a distance T and a distance L satisfy a relationship in Expression 2, the distance T being a distance between the rear end of the first shoulder and the tip end of the second shoulder along the axial direction, the distance L being a distance between the rear end of the first shoulder and a tip end face of the metal shell along the axial direction:

$$Da/Db \geq 1.1 \quad \text{(Expression 1)}$$

$$T/L \leq 0.5 \quad \text{(Expression 2).}$$

2. The spark plug according to claim 1, wherein a distance Dc is equal to or more than 0.2 mm, the distance Dc being a distance between the tip end of the second shoulder and the tip end of the trunk portion along the axial direction.

3. The spark plug according to claim 1 or claim 2, wherein a distance Db' between a point on the leg and the second shoulder along the radial direction satisfies a relationship in Expression 3, the point being shifted to the tip end side by 0.1 mm along the axis line from the tip end of the trunk portion:

$$Db' \leq 1.8 \times Db \quad \text{(Expression 3).}$$

4. The spark plug according to claim 1 or 2, wherein the second shoulder is formed to have an inner diameter that expands from a rear end side toward a tip end side.

5. The spark plug according to claim 1 or 2, wherein the trunk portion is formed to extend along the axis line with a constant outer diameter.

* * * * *

UNITED STATES PATENT AND TRADEMARK OFFICE

CERTIFICATE OF CORRECTION

PATENT NO. : 8,791,627 B2
APPLICATION NO. : 14/034610
DATED : July 29, 2014
INVENTOR(S) : Ozeki et al.

It is certified that error appears in the above-identified patent and that said Letters Patent is hereby corrected as shown below:

Title Page

Item (54) Title: Delete “occurance”, and insert -- occurrence --.

Signed and Sealed this
Seventh Day of October, 2014

Michelle K. Lee

Michelle K. Lee
*Deputy Director of the United States Patent and Trademark Office*